United States Patent [19]

Gilbert et al.

[11] 4,240,900

[45] Dec. 23, 1980

[54] PROCESS FOR THE HYDROGENATION OF OLEFINS AND AROMATIC COMPOUNDS

[75] Inventors: John B. Gilbert, Sarnia; H. Clarke Henry, Dartmouth, both of Canada

[73] Assignee: Exxon Research & Engineering Co., Florham Park, N.J.

[21] Appl. No.: 40,226

[22] Filed: May 18, 1979

Related U.S. Application Data

[63] Continuation-in-part of Ser. No. 962,979, Nov. 22, 1978, abandoned, which is a continuation of Ser. No. 501,163, Aug. 28, 1974, abandoned, which is a continuation-in-part of Ser. No. 331,800, Feb. 12, 1973, abandoned.

[51] Int. Cl.[3] ..... C10G 45/54

[52] U.S. Cl. ..... 208/143; 208/264

[58] Field of Search ..... 208/143, 264

[56] References Cited

U.S. PATENT DOCUMENTS

| | | | |
|---|---|---|---|
| 3,459,656 | 8/1969 | Rausch | 208/143 |
| 3,547,807 | 12/1970 | Hansford | 208/111 |
| 3,592,757 | 7/1971 | Bard | 208/111 |
| 3,730,878 | 5/1973 | Pollitzer | 208/143 |
| 3,779,899 | 12/1973 | Mears | 208/143 |
| 3,788,972 | 1/1974 | Henry et al. | 208/59 |

*Primary Examiner*—Herbert Levine

*Attorney, Agent, or Firm*—Joseph J. Allocca; Edward M. Corcoran

[57] ABSTRACT

Olefins and aromatic compounds in mixed hydrocarbon streams boiling above about 200° F. are hydrogenated at a temperature ranging between about 400° F.–720° F. using a zeolite-containing catalyst that has been treated with a hydrocarbon stream relatively high in organic nitrogen compounds to suppress the cracking activity of the catalyst. The catalyst comprises (1) an amorphous base component, (2) a crystalline aluminosilicate component preferably comprising 5–30 wt. % of the total catalyst and having a silica/alumina mole ratio of at least 2.5 and an alkali metal content of less than about 2.0 wt. %, and (3) a transition metal hydrogenation component. The process is particularly useful in the manufacture of jet fuels and technical white oils and white oil bases with a minimum conversion of feed (<20%) to substantially lower boiling products.

20 Claims, 1 Drawing Figure

CONVERSION OF FEED AS A FUNCTION OF TEMPERATURE AND CATALYST CRYSTALLINE ALUMINOSILICATE CONTENT

CONVERSION OF FEED AS A FUNCTION OF TEMPERATURE AND CATALYST CRYSTALLINE ALUMINOSILICATE CONTENT
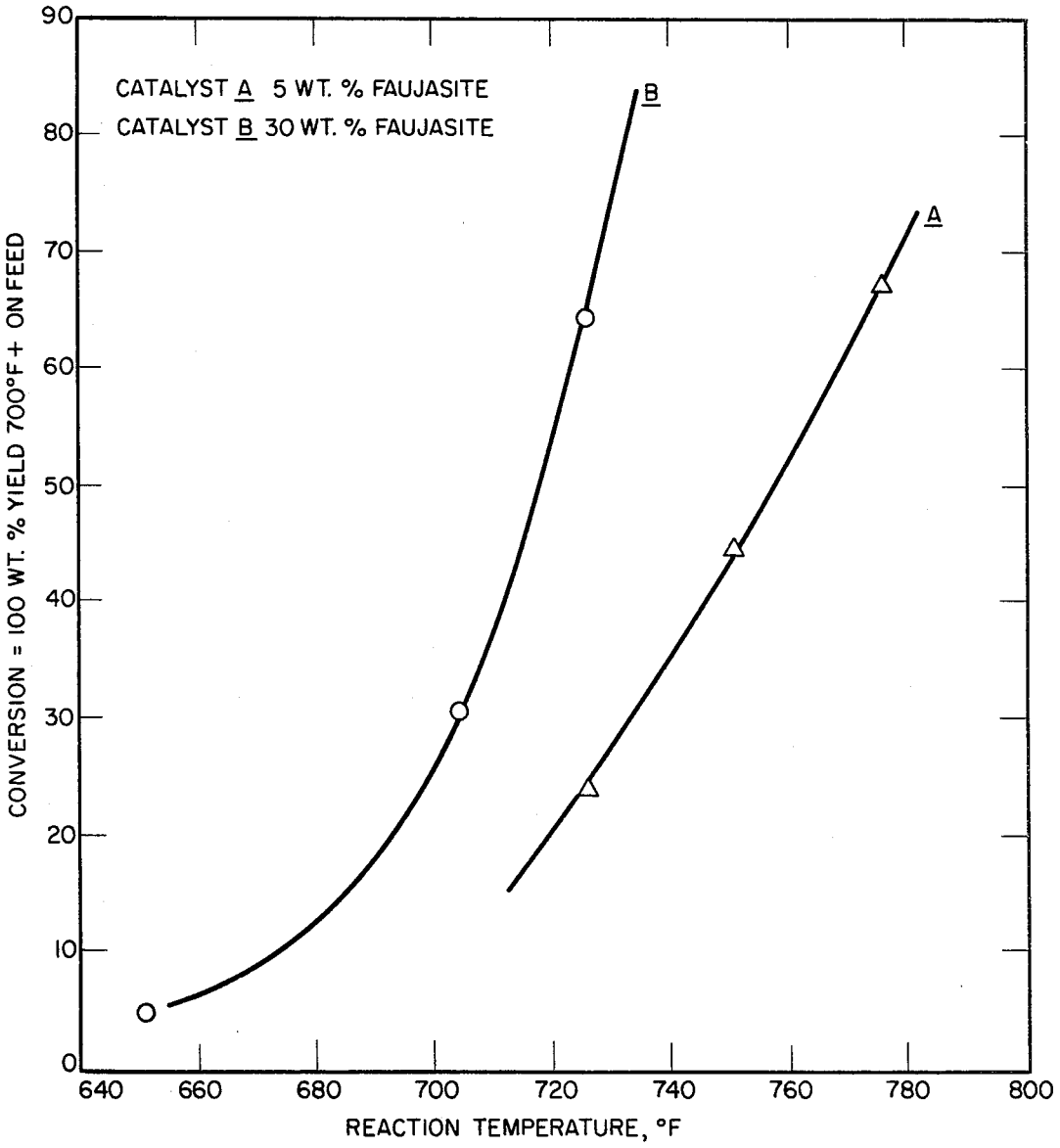

PROCESS FOR THE HYDROGENATION OF OLEFINS AND AROMATIC COMPOUNDS

CROSS-REFERENCE TO RELATED APPLICATIONS

This application is a Continuation-in-Part of Ser. No. 962,979, filed Nov. 22, 1978, which is a Rule 60 Continuation of Ser. No. 501,163, filed Aug. 28, 1974, which in turn is a Continuation-in-Part of U.S. Ser. No. 331,800, filed Feb. 12, 1973, all now abandoned.

FIELD OF THE INVENTION

This invention relates to hydrocarbon conversion processes. More particularly, this invention relates to an improved process for the hydrogenation of olefinic and aromatic compounds. Still more particularly, this invention relates to an improved process for producing jet fuels and white oils wherein the improvement comprises pretreating a hydrocracking catalyst with nitrogen-containing organic compounds for a time sufficient to suppress the cracking activity of the catalyst and then using said treated catalyst to hydrogenate jet fuel and white oil distillates at a temperature ranging from about 450° F. to about 720° F.

DESCRIPTION OF THE PRIOR ART

The improvement in the qualities of various petroleum base products through catalytic hydrogenation has long been known in the art. Typically, the catalyst system of the prior art would comprise an amorphous refractory metal oxide, such as alumina, and a hydrogenation component being a metal (or its oxide or sulfide) selected from Groups VI-B and/or VIII of the Periodic Table. The metals primarily in use are the oxides of nickel, cobalt, molybdenum and tungsten. These prior art methods, however, generally employ severe conditions of temperature and pressure and/or require multiple steps.

Another type of hydrogenating catalyst well known in the prior art would be one of the Group VIII noble metals, such as platinum, deposited on a porous carrier such as alumina. This type of catalyst is often preferred because of its high hydrogenating activity, relatively low loss of feed to substantially lower boiling products and relatively mild operating conditions. However, this type of catalyst is easily deactivated by small amounts of sulfur contained in the feed.

For various purposes, such as the production of white oils and white oil bases or improving the characteristics of jet fuels, it would be desirable to have a more economically attractive hydrogenation process. It is therefore a principal object of this invention to develop a process for hydrogenating olefins and aromatic compounds in jet fuels and white oils which would operate under relatively milder conditions and have a relatively high level of hydrogenating activity or low conversion of said feed to substantially lower boiling products and not be poisoned by sulfur-containing feeds.

SUMMARY OF THE INVENTION

A process for hydrogenating the olefin and aromatic compounds present in hydrocarbon feedstocks which comprises contacting said feedstock with hydrogen at hydrogenating conditions, including a temperature ranging from between about 400° F. to 720° F., in the presence of a catalyst comprising a mixture of (1) an amorphous base component, (2) a crystalline aluminosilicate component comprising from 5–70 wt. % of the total catalyst and having a silica/alumina mole ratio of at least 2.5 and an alkali metal content of less than about 2.0 wt. % as alkali oxide, based on the total aluminosilicate component, and (3) a hydrogenation component, wherein said catalyst is pretreated with a hydrocarbon stream containing at least about 100 ppm of nitrogen as nitrogen-containing organic compounds for a time sufficient to suppress cracking activity of the catalyst before same is used to hydrogenate the feedstocks.

The process of this invention is useful for hydrogenating hydrocarbon streams having an initial boiling point above about 200° F. (at atmospheric pressure) containing olefins and aromatics with a minimum hydrocracking conversion of the feed (i.e., less than 20 wt. %) to substantially lower boiling products such as gasoline. It has been found to be especially useful for producing white oils, white oil bases and for improving the characteristics of jet fuel. In a preferred embodiment of this invention the feed will be substantially free (i.e., substantially less than 100 ppm) from nitrogen.

An important aspect of this invention is pretreating the catalyst with a hydrocarbon stream relatively high in nitrogen-containing organic compounds or ammonia precursors for a time sufficient to suppress the cracking activity of the catalyst before it is used to hydrogenate the feedstock. This type of catalyst is basically a cracking catalyst, but it has been found that treating same with a relatively high amount of nitrogen as nitrogen-containing organic compounds substantially suppresses the hydrocracking activity thereof, yielding a catalyst that is both sulfur and nitrogen resistant and which has relatively high hydrogenating activity. The so-treated catalyst is thus a sulfur and nitrogen-resistant hydrogenating catalyst useful for producing white oils and jet fuels without incurring the intolerable losses of oil or jet fuel yields to lower boiling products, such as gasoline, normally associated with using such zeolite-containing catalysts.

Any petroleum distillate hydrocarbon stream containing organic nitrogen compounds may be used to treat the catalyst, but preferably the stream contains at least 100 ppm of nitrogen and no more than 5 ppm of metals. By organic nitrogen compounds or nitrogen-containing organic compounds is meant those classes of nitrogeneous compounds which naturally occur in petroleum distillate steams, such as, but not limited to, pyrridines, pyrroles and associated compounds. The catalyst may be treated by contacting it with the organic nitrogen-containing hydrocarbon either simultaneously with the feedstock or prior to contacting the catalyst with the feedstock. The catalyst is preferably treated prior to contacting it with the feedstock in which case the catalyst is said to be pretreated.

There are three different methods by which the catalyst may be treated or pretreated. One method is by pretreating the catalyst with a high nitrogen-containing hydrocarbon stream, such as a petroleum distillate, other than the feedstock to be hydrogenated. Another method is to add organic-containing nitrogen compounds to the feed if the feed normally contains less than 100 ppm of nitrogen, for a time sufficient to suppress the cracking activity of the catalyst. Of course, after the cracking activity of the catalyst is suppressed, the catalyst then functions to hydrogenate the feed, and it will no longer be necessary to add the nitrogen compounds to the feed. Yet another method is to suppress the cracking activity of the catalyst in-situ via contact with a feed to be hydrogenated that is relatively high (i.e., >100 ppm) in nitrogen as nitrogen-containing organic compounds. In this case, initial contact with the feedstock inherently results in substantially suppressing the hydrocracking activity of the catalyst after which the catalyst functions to hydrogenate the feed with a minimum hydrocracking conversion of the feed (i.e., less than 20 wt. %) to lower boiling products during the subsequent hydrogenation.

Another important aspect of this invention relates to the discovery that in order to minimize hydrocracking the feed to less than about 20 wt. % of substantially lower boiling products, the hydrogenation temperature should not exceed about 720° F. It has been found that the maximum hydrogenation temperature meeting these requirements is a function of the crystalline aluminosilicate content of the catalyst, with the maximum temperature of 720° F. corresponding to about 5 wt. % crystalline aluminosilicate in the catalyst. By lower boiling products it is meant products boiling below about the initial boiling point of the feed. It has been found that if the hydrogenating temperature exceeds about 720° F. or 700° F. for 5 or 30 wt. % crystalline aluminosilicate content of the catalyst, respectively, even in the presence of high nitrogen-containing feeds, substantial amounts of the feed are hydrocracked to lower boiling products. This phenomenon is illustrated in the FIGURE which is a plot of the amount of conversion of a high nitrogen-containing feed to products boiling below about the initial boiling point of the feed, as a function of hydrogenation temperature over two catalysts useful in this invention which contain 5 and 30 wt. % faujasite and is explained in more detail in Example 5, infra.

The catalyst may be treated or pretreated and used as a fixed, fluid or ebulating bed. The following conditions have been found suitable for treating or pretreating the catalyst with a feed containing organic nitrogen compounds.

| | Operative | Preferred |
|---|---|---|
| Temperature (°F.) | 400-750 | 450-700 |
| $H_2$ Partial Pressure (psi) | 500-10,000 | 1000-3000 |
| Liquid Space Velocity (V/V/hr) | 0.1-10.0 | 0.25-1.5 |
| Hydrogen Gas Rate (SCF/B) | 500-10,000 | 1000-5000 |
| Time of Pretreatment (hrs.) | 5-200 | 12-72 |
| Concentration of nitrogen-containing organic compounds in treating stream, measured as ppm of nitrogen | 100-5000 | 500-1000 |

The process of this invention is applicable to the hydrogenation of any hydrocarbon stream containing olefins and aromatics. It is especially useful in the production of technical white oils and white oil bases and for the purpose of improving the characteristics of jet fuel.

The following are the operative and preferred hydrogenation conditions for the process of this invention.

| | Operative | Preferred |
|---|---|---|
| Temperature (°F.) | 400-720 | 550-650 |
| $H_2$ Partial Pressure (psi) | 600-10,000 | 1000-2000 |
| Liquid Space Velocity (V/V/hr) | 0.1-10.0 | 0.25-1.0 |
| Hydrogen Gas Rate (SCF/B) | 500-10,000 | 1000-5000 |

Catalyst activity may diminish after sixty or more days of continual use. However, the catalyst may be regenerated by conventional techniques involving, for example, controlled combustion, to remove the inactivating deposits from the catalyst surface.

Feestocks that are suitable for use in the subject process include hydrocarbons, mixtures of hydrocarbons, and particularly hydrocarbon fractions the predominant portions of which exhibit initial boiling points above about 200° F. Unless otherwise indicated, boiling points are taken at atmospheric pressure. Non-limiting examples of useful process feedstocks include crude oil distillates from paraffinic or naphthenic crudes, deasphalted residual oils, fractions of catalytic cracking cycle oils, coker distillates, thermally cracked oils, hydrocracked oils and/or solvent raffinates and the like. These fractions may be derived from petroleum crude oils, shale oils, tar sand oils, coal hydrogenation products and the like. Preferred feedstocks for the manufacture of jet fuel exhibit an initial boiling point in the range 200°-400° F. and a final boiling point in the range 500°-600° F. Preferred feedstocks for technical white oils and white oil bases include raw and/or semi-refined distillates from naphthenic or paraffinic crudes. For white oil production, the viscosity and gravity of the product are the main specifications which define the feedstock.

The process of this invention can be effected at the foregoing reaction conditions and in contact with the catalyst to be described more fully below, in conventional or otherwise convenient manner. For example, the feedstock can be preheated and charged to a high pressure vessel utilized as a hydrotreater. The feedstock can be comingled with hydrogen prior to its being charged to the hydrotreater or, alternatively, the feedstock and the hydrogen can be charged into the hydrotreater in individual and separate streams. Preferably, the catalyst is disposed in one or more fixed beds within a reaction zone of the hydrotreater, and the feedstock and hydrogen being charged up-flow and/or downflow in contact therewith. The hydrotreater effluent is cooled and then passed to a high pressure separator where it is separated into a normally liquid hydrogenated product and a normally gaseous stream. The normally gaseous stream, comprising principally hydrogen may be, if desired, recycled to the hydrotreater as a portion of the hydrogen charge. Alternatively, a portion of the gaseous stream may be vented for the purpose of maintaining hydrogen purity in the hydrotreater. For some applications, in order to meet product flash point and/or viscosity specifications, it is necessary to remove low boiling components from the normally liquid hydrogenated product by atmospheric or vacuum stripping.

The catalyst which is to be treated in accordance with this invention comprises a mixture of (1) an amorphous component, (2) 5 to 70 wt. % (based on total catalyst) of a crystalline aluminosilicate component and (3) a hydrogenation component. Catalysts of this type are exemplified and described more completely in U.S. Pat. Nos. 3,547,807 and 3,304,254, the disclosures of which are incorporated herein by reference.

Preferably, the catalyst comprises a mixture of (1) a major component comprising an amorphous support upon which is deposited one or more transitional metal hydrogenation components, preferably selected from Groups VI-B and VIII metals of the Periodic Table in the form of the oxides and/or sulfides thereof and (2) a minor component comprising a crystalline aluminosilicate zeolite having a silica/alumina mole ratio greater than about 2.5 and an alkali metal content of less than 2.0 wt. % (as alkali metal oxide) based on the final aluminosilicate composition and containing deposited thereon or exchanged therewith one or more traditional metal hydrogenation components preferably selected from Groups VI-B and VIII metals of the Periodic Table in the form of the oxides and/or sulfides thereof.

The amorphous component (support) of the catalyst can be one or more of a large number of inorganic non-crystalline materials having high porosity. Representative porous materials that can be employed include metals and metal alloys; sintered glass; firebrick; diatomaceous earth; inorganic refractory oxides; metal phosphates such as boron phosphate, calcium phosphate and zirconium phosphate; metal sulfides such as iron sulfide and nickel sulfide; inorganic oxide gels and the like. Preferred inorganic oxide support materials include one or more oxides of metals selected from Groups II-A, III-A and IV of the Periodic Table. Non-limiting examples of such oxides include aluminum oxide, titania, zirconia, magnesium oxide, silicon oxide, titanium oxide, silicastabilized alumina and the like.

Suitable hydrogenation components that can be added to the porous support are the transitional metal oxides and/or sulfides. The metals are preferably selected from Groups VI-B and VIII of the Periodic Table and are exemplified by chromium, molybdenum, tungsten, cobalt, nickel, palladium, iron, rhodium, and the like. The metal oxides or sulfides may be added alone or in combination to the support. The preferred hydrogenation components are nickel, tungsten and molybdenum metal oxides and/or sulfides. The hydrogenation components are added to the support in minor proportions ranging from about 1 to 25% by weight based on the total amorphous component of the catalyst.

Preferably, the starting catalyst composition comprises a silica/alumina support containing molybdenum trioxide and nickel oxide hydrogenation components. The silica/alumina weight ratio in the amorphous support can range from 20:1 to 1:20 and preferably from 1:4 to 1:6. The molybdenum trioxide/nickel oxide weight ratio in the amorphous support can range from about 1:25 to 25:1 and preferably from 6:1 to 4:1. Finally, the weight ratio of the support to the hydrogenation component can range from about 20:1 to 1:20 and preferably from 4:1 to 8:1.

The amorphous component of the catalyst can be prepared in any suitable manner. Thus, for example, if silica/alumina is employed, the silica and alumina may be mechanically admixed or, alternatively, chemically composited with the metal oxides such as by cogelation. Either the silica or alumina may, prior to admixture with the other, have deposited thereon one or more of the metal oxides. Alternatively, the silica and alumina may first be admixed and then impregnated with the metal oxides.

The crystalline aluminosilicate (sieve component) employed in the preparation of the crystalline component of the catalyst comprises one or more natural or synthetic zeolites. Representative examples of particularly preferred zeolites are zeolite X, zeolite Y, zeolite L, faujasite and mordenite. Synthetic zeolites have been generally described in U.S. Pat. Nos. 2,882,244; 3,130,007 and 3,216,789, the disclosures of which are incorporated herein by reference.

The silica/alumina mole ratio of useful aluminosilicates is greater than 2.5 and preferably ranges from about 2.5 to 10. Most preferably this ratio ranges between about 3 and 6. These materials are essentially the dehydrated forms of crystalline hydrous siliceous zeolites containing varying quantities of alkali metal and aluminum with or without other metals. The alkali metal atoms, silicon, aluminum and oxygen in the zeolites are arranged in the form of an aluminosilicate salt in a definite and consistent crystalline structure. The structure contains a large number of small cavities, interconnected by a number of still smaller holes or channels. These cavities and channels are uniform in size. The pore diameter size of the crystalline aluminosilicate can range from 5 to 15 Å and preferably from 5 to 10 Å.

The aluminosilicate component may comprise a sieve of one specific pore diameter size or, alternatively, mixtures of sieves of varying pore diameter size. Thus, for example, mixtures of 5 Å and 13 Å sieves may be employed as the aluminosilicate component. Synthetic zeolites such as type-Y faujasites are preferred and are prepared by well-known methods such as those described in U.S. Pat. No. 3,130,007.

The aluminosilicate can be in the hydrogen form, in the polyvalent metal form, or in the mixed hydrogen-polyvalent metal form. The polyvalent metal or hydrogen form of the aluminosilicate component can be prepared by any of the well-known methods described in the literature. Representative of such method is ion-exchange of the alkali metal cations contained in the aluminosilicate with ammonium ions or other easily decomposable cations such as methylsubstituted quaternary ammonium ions. The exchanged aluminosilicate is then heated at elevated temperatures of about 300°-600° C. to drive off ammonia, thereby producing the hydrogen form of the material. The degree of polyvalent-metal or hydrogen exchange should be at least about 20%, and preferably at least about 40% of the maximum theoretically possible. In any event, the crystalline aluminosilicate composition should contain less than about 6.0 wt. % of the alkali metal oxide based on the final aluminosilicate composition and, preferably, less than 2.0 wt. %, i.e., about 0.3 wt. % to 0.5 wt. % or less.

The resulting hydrogen aluminosilicate can be employed as such, or can be subjected to a steam treatment at elevated temperatures, i.e., 427° to 704° C. for example, to effect stabilization, thereof, against hydrothermal degradation. The steam treatment, in many cases, also appears to effect a desirable alteration in crystal structures resulting in improved selectivity.

The mixed hydrogen-polyvalent metal forms of the aluminosilicates are also contemplated. In one embodiment, the metal form of the aluminosilicate is ion-exchanged with ammonium cations and then partially back-exchanged with solutions of the desired metal salts until the desired degree of exchange is achieved. The remaining ammonium ions are decomposed later to hydrogen ions during thermal activation. Here again, it is preferred that at least about 40% of the monovalent metal cations be replaced with hydrogen and polyvalent metal ions.

Suitably, the exchanged polyvalent metals are transition metals and are preferably selected from Groups VI-B and VIII of the Periodic Table. Preferred metals include nickel, molybdenum, tungsten and the like. The most preferred metal is nickel. The amount of nickel (or other metal) present in the aluminosilicate (as ion-exchanged metal) can range from 0.1 to 20% by weight based on the final aluminosilicate composition.

In addition to the ion-exchanged polyvalent metals, the aluminosilicate may contain as non-exchanged constituents one or more hydrogenation components comprising the transitional metals, preferably selected from Groups VI-B and VIII of the Periodic Table in the form of their oxides and sulfides. Such hydrogenation components may be combined with the aluminosilicate by any method which gives a suitably intimate admixture, such as by impregnation. Examples of suitable hydrogenation metals, for use herein, include the oxides and/or sulfides of nickel, tungsten, molybdenum, platinum, and the like. Mixtures of any two or more of such components may also be employed. Particularly preferred metals are tungsten and nickel in the form of their oxides. The total amount of hydrogenation components present in the final aluminosilicate composition can range from about 1 to 50 wt. %, preferably from 10 to 25 wt. % based on the final aluminosilicate composition. The final weight % composition of the crystalline component of the total catalyst will range from about 5 to 70 wt. % and preferably from about 5 to 30 wt. %, e.g., 20 wt. % based on total catalyst.

The amorphous component and the crystalline aluminosilicate component of the catalyst may be brought together by any suitable method, such as by mechanical mixing of the particles thereby producing a particle form composite that is subsequently dried and calcined. The catalyst may also be prepared by extrusion of wet plastic mixtures of the powdered components followed by drying and calcination. Preferably, the complete catalyst is prepared by mixing the metal-exchanged zeolite component with alumina or silica-stabilized alumina and extruding the mixture to form catalyst pellets. The pellets are thereafter impregnated with an aqueous solution of nickel and molybdenum or tungsten materials to form the final catalyst.

A particularly preferred catalyst composition comprises:

| | |
|---|---|
| NiO | 3 wt. % |
| $MoO_3$ | 16 wt. % |
| Ni-faujasite | 20 wt. % |
| $Al_2O_3$ | Remainder |

The catalyst is preferably presulfided by conventional methods such as by treatment with hydrogen sulfide or carbon disulfide prior to use. The precise chemical identity of the hydrogenation constituents present on the support during the course of the hydrogenation operation is not known. However, the hydrogenation components probably exist in a mixed elemental metal/metal oxide/metal sulfide form. After sulfiding, the catalyst is treated with a hydrocarbon stream containing at least 100 ppm of nitrogen as nitrogen-containing organic compounds under the conditions heretofore described, supra. The mechanism by which the nitrogen compounds suppress the cracking activity of the catalyst while leaving the hydrogenating activity substantially uneffected is not known. However, it is believed that the nitrogen in the hydrocarbon stream converts to ammonia and it is nitrogen substantially in the form of ammonia that is responsible for suppressing the cracking activity.

BRIEF DESCRIPTION OF THE DRAWING

The drawing is a graph illustrating the amount of conversion of a relatively high nitrogen-containing feed to lower boiling products as a function of hydrogenation temperature over two catalysts useful in this invention which differ from each other in faujasite content.

PREFERRED EMBODIMENTS

The following examples illustrate the effectiveness of obtaining primarily hydrogenating activity by pretreating the catalyst of this invention with a nitrogen-containing hydrocarbon stream.

EXAMPLE 1

A phenol raffinate from Coastal Crude was hydrotreated using a sulfided catalyst, according to the process of this invention, that had not been pretreated with an organic nitrogen-containing hydrocarbon stream. The same catalyst was then treated with an organic nitrogen-containing hydrocarbon stream as heretofore described and again used to hydrotreat another sample of the same Coastal Crude phenol raffinate. The nitrogen-containing hydrocarbon stream used to pretreat the catalyst was a Tia Juana raw distillate and the Coastal Crude phenol raffinate are shown in Table I. The composition of the catalyst is also shown in Table I, while the conditions used to treat the catalyst are given in Table II.

The results of these runs are shown in Table II. The data in Table II clearly show that the hydrocracking activity of the catalyst was greatly suppressed by pretreating the catalyst with the organic nitrogen-containing Tia Juana raw distillate. Comparing the properties of the untreated raffinate feed listed in Table I with the properties of the same feed after passing it over both the treated and untreated catalyst per Table II (Total Liquid Product), we see that there has been over an order of magnitude reduction in the viscosity of the feed passed over the untreated catalyst, along with a substantial reduction in refractive index and increase in API gravity. This shows that the untreated catalyst substantially hydrocracked the feed. On the other hand, comparing these same properties for the raffinate feed passed over the treated catalyst shows that little or no hydrocracking occurred. This is indicated by the minor reduction in viscosity and refractive index, along with no increase in API gravity.

The Tia Juana raw distillate is naphthenic in nature and the designation 58/60 LCT per Table I refers to the fact that the viscosity range is between 58–60 SUS at 100° F. and that it is a low cold test or low pour point distillate. As indicated in Table I, the nitrogen content was about 500 ppm.

TABLE I

PROPERTIES OF FEEDS USED IN CATALYST[1] ACTIVITY TESTS

| | Naphthenic Raffinate From Coastal Crude | 58/60 LCT Distillate From Tia Juana Crude |
|---|---|---|
| Gravity, °API | 27.1 | 27.5 |
| Sp. Gr. 60° F. | 0.8922 | 0.8899 |
| Viscosity at 100° F., SUS | 475 | 59.3 |
| Refractive Index at 60° F. | 1.4738 | 1.4787 |
| Sulfur, wt. % | 0.08 | 1.1 |
| Aromatics, wt. % | 15 | 38 |
| Nitrogen, ppm | 6 | ~500 |

[1]Catalyst composition: 3% NiO/16% $MoO_3$/20% Ni-Faujasite/remainder alumina.

TABLE II

REDUCTION OF CATALYST[1] HYDROCRACKING ACTIVITY BY TREATING WITH FEED CONTAINING ORGANIC NITROGEN COMPOUNDS

| | BEFORE TREATMENT | TREATMENT | AFTER Treatment |
|---|---|---|---|
| | Naphthenic Raffinate from Coastal Crude | 58/60 LCT Distillate from Tia Juana Crude | Naphthenic Raffinate from Coastal Crude |
| Feed[1] | | | |
| Cat. Age, hr. | 123–180 | 180–236 | 236–253 |
| Temperature, °F. | 550 | 500 | 550 |
| Pressure, psig[2] | 2000 | 2500 | 2000 |
| LHSV, V/V/hr. | 0.5 | 1.0 | 0.5 |
| Total Liquid Product ($C_{5+}$) | | | |
| Gravity, °API | 48.6 | — | 27.3 |
| Sp. Gr. 60° F. | 0.7857 | — | 0.8911 |
| Viscosity at 100° F., SUS | 33 | — | 431 |
| Refractive Index at 60° F. | 1.4150 | — | 1.4718 |

[1]See Table I for composition of catalyst and feed.
[2]Gas Rate-5000 SCF (100%) $H_2$/B.

The catalyst composition was 3% NiO/16% $MoO_3$/20% Ni-Faujasite/remainder alumina and was prepared under the following procedure and conditions.

A sample of commercial sodium-faujasite was converted to the ammonium form by contacting it with ammonium nitrate solution for 48 hours. After washing with water, the material was further contacted with nickel nitrate solution to partially exchange nickel ions for ammonium ions. After calcination at about 1000° F. to drive off ammonia and convert residual ammonium ions to hydrogen ions, the faujasite base contained about 10 wt. % nickel (calculated as NiO) and less than 1 wt. % sodium (calculated as $Na_2O$).

The exchanged faujasite base (20 parts by weight) and amorphous alumina (80 parts by weight) were mulled with water to produce a mixture which could be extruded in a batch piston extruder. After extrusion, the material was dried overnight in a draft oven at 300° F. The extrudate, about 1/16" in diameter, was broken to suitable lengths, screened to remove fines and calcined for 2 hours at 1000° F. Molybdenum was added by wetting and catalyst with an ammonium molybdate solution and drying it overnight at about 300° F. Similarly, nickel was added using a nickel nitrate solution. Finally, the catalyst was calcined for 3 hours at 1000° F.

EXAMPLE 2

This Example illustrates the relatively high conversion ratio of feed to lube oil products using the pretreated catalyst of Example 1 as compared to the relatively low (less than about 50%) conversion ratio to useful lube oil products normally associated with the use of this type of catalyst. As shown in Table III, the feed of this Example was a lube oil cut (boiling above 710° F.) of a hydrocracked, 50/50 blend of a high vacuum gas oil and a deasphalted oil. A portion of this feed was passed over the pretreated catalyst of Example 1 while another portion of the same feed was passed over a sample of the same catalyst which had not been pretreated with a high nitrogen-content hydrocarbon stream. The results obtained by analysis of the products of the experiments are compared in Table IV.

The catalyst not pretreated by the process of this invention had fairly high hydrogenation activity at 550° F., giving products meeting or approaching the specifications for technical white oils. Because of high hydrocracking activity however, the total 710° F. +waxy lube yield was only 32.9 wt. %, corresponding to a conversion to low boiling products of 67.1 wt. %. The pretreated catalyst, however, gave much lower conversions to low boiling products —1.8 wt. % at 550° F. and 6.3 wt. % at 600° F. These operations gave very extensive saturation of aromatics and the hydrogenated lube fractions would be suitable for use as technical white oils.

The following examples illustrate the advantages of the process of this invention in the preparation of technical white oils.

TABLE III

FEEDSTOCK FOR PRODUCTION OF TECHNICAL WHITE OIL BY HYDROGENATION

| | Total Feed[1] | Fraction I[2] | Fraction II[2] |
|---|---|---|---|
| Boiling Range, °F. | 710+ | 710–950 | 950+ |
| Yield, Wt % | 100 | 55.7 | 44.3 |
| Gravity, °API | 31.7 | 31.8 | 31.6 |
| Visc at 210° F., SUS | 54.4 | 44.4 | 80.6 |
| Pour Pt., °F. | 105 | 95 | 110+ |
| Wax, Wt % | 22.2 | 15.1 | 29.0 |
| Sulfur, ppm | 155 | — | — |
| Dewaxed Feed[3] | | | |
| Yield, Wt % | 77.8 | 46.3 | 31.5 |
| Visc at 100° F., SUS | 290.7 | 165.9 | 740 |
| 210° F., SUS | 53.8 | 44.9 | 80.3 |
| Visc Index | 109 | 109 | 108 |
| Pour Pt., °F. | 0 | 0 | 0 |
| Color, ASTM | L4.5 | L2.0 | 6.0 |
| Aromatics, Wt %[4] | 17.9 | 21.1 | 13.8 |
| UV Absorption, K, 280 nm | — | 3.21 | 0.72 |

[1]710° F.+ product from hydrocracking 50/50 blend of heavy vacuum gas oil and deasphalted oil
[2]Obtained by vacuum distillation of total feed
[3]By solvent dewaxing at −10° F.
[4]By silica gel chromatography

TABLE IV

PRODUCTION OF TECHNICAL WHITE OILS BY HYDROGENATION

| | Catalyst NOT Pretreated | Catalyst Pretreated | | |
|---|---|---|---|---|
| Run No. | 25-29-2 | 25-31-2 | 25-31-3 | 25-31-4 |

TABLE IV-continued

PRODUCTION OF TECHNICAL WHITE OILS BY HYDROGENATION

| | Catalyst NOT Pretreated | | | | Catalyst Pretreated | | | |
|---|---|---|---|---|---|---|---|---|
| Ave cat-age, hr | 138 | | 291 | | 329 | | 364 | |
| Temperature, °F. | 550 | | 550 | | 600 | | 600 | |
| Pressure, psig | 2000 | | | | | | 2500 | |
| LHSV, V/V/hour | 0.5 | | | | | | | |
| Gas Rate, SCF $H_2$/B | 5000 | | | | | | | |
| $H_2$ Purity, % | 100 | | | | | | | |
| Total Liquid Product ($C_5$+) | | | | | | | | |
| Recovery, Wt % | 88.0 | | 98.3 | | 97.6 | | 96.4 | |
| Gravity, °API | 51.9 | | 33.1 | | 33.9 | | 34.8 | |
| Oil Product | | | | | | | | |
| Boiling Range, °F. | 710-950 | 950+ | 710-950 | 950+ | 710-950 | 950+ | 710-950 | 950+ |
| Yield, Wt %[12.5] | 20.4 | 53.9 | 44.3 | 51.4 | 42.3 | 47.1 | 41.7 | |
| Visc at 210° F., SUS | 44.0 | 80.6 | 45.0 | 80.8 | 44.4 | 80.3 | 43.7 | 79.5 |
| Pour, °F. | 75+ | 75+ | 75+ | 75+ | 75+ | 75+ | 75+ | 75+ |
| Wax, Wt %[2] | 17.8 | 29.2 | 15.2 | 28.0 | 17.1 | 29.2 | 17.1 | 30.0 |
| Dewaxed Oil[2] | | | | | | | | |
| Yield, Wt %[1] | 10.3 | 14.4 | 45.6 | 30.3 | 42.6 | 29.9 | 39.1 | 29.3 |
| Visc at 100° F., SUS | 154.8 | 840 | 173.6 | 805 | 162.4 | 776 | 149.5 | 751 |
| 210° F., SUS | 44.5 | 86.6 | 45.6 | 86.5 | 44.8 | 85.0 | 44.0 | 83.4 |
| Viscosity Index | 117 | 110 | 113 | 115 | 114 | 115 | 115 | 115 |
| Pour Point, °F. | 0 | 5 | 0 | 5 | 0 | 0 | 0 | 5 |
| Color, ASTM | L0.0 | L1.0 | L0.0 | L0.5 | L0.0 | L1.0 | L0.0 | L0.5 |
| Aromatics, Wt %[3] | 2.7 | 2.1 | 6.4 | 5.5 | 2.1 | 3.4 | 0.4 | 1.5 |
| Aromatics Conversion, % | 88 | 85 | 70 | 60 | 90 | 75 | 98 | 89 |
| UV Absorption, K, 280 nm | 0.143 | 0.049 | 0.151 | 0.118 | 0.059 | 0.067 | 0.022 | 0.032 |
| UV Absorption, ATSM D2008 | | | | | | | | |
| 275 nm | 12.20 | 4.21 | 13.4 | 10.31 | 5.10 | 5.82 | 1.93 | 2.79 |
| 295-9 | 10.18 | 5.12 | 9.96 | 6.02 | 8.22 | 7.51 | 2.57 | 3.29 |
| 300-400 | 8.20 | 5.43 | 6.67 | 5.02 | 7.57 | 7.28 | 2.31 | 3.63 |

[1]Based on feed to hydrogenation
[2]Solvent dewaxing at −10° F.
[3]By silica gel chromatography

EXAMPLE 3

A dewaxed phenol raffinate from Tia Juana 102 crude oil was hydrotreated using two catalysts, Catalyst A, having the composition and pretreatment according to Example 1 and Catalyst B, a conventional cobalt molybdate on alumina. The same pressure, gas rate and feed rate conditions were used with both catalysts. Hydrotreating severity in each case was controlled by the temperature and was adjusted to the highest level possible consistent with the minimum acceptable specific gravity (0.868) of the hydrotreated product after topping. With Catalyst A (this invention), a temperature of 600° F. gave a product of 0.869 specific gravity. With Catalyst B (prior art), a temperature of 670° F. was required for approximately the same specific gravity value, 0.870.

Catalyst B was the commercial product Spence 5/25 Comox, and has the following nominal composition: 5.2% cobalt oxide/25.3% molybdenum oxide/remainder alumina. Both catalysts A and B were presulfided by conventional techniques prior to use, e.g., treatment with $H_2S$ diluted with hydrogen. In addition to being presulfided, Catalyst A was also pretreated using an organic nitrogen-containing feed as hereinbefore mentioned in Example 1.

The hydrogenated products resulting from use of the two catalysts had similar viscosities and could be brought to exactly the same viscosity level by adjusting the topping temperature without significantly affecting other properties such as specific gravity, sulfur and aromatic content, etc. Sulfur content in both cases was less than 10 ppm.

The comparative data are shown in the following table.

TABLE V

HYDROTREATING TIA JUANA PHENOL RAFFINATE
Conditions: 1950 psig $H_2$ (100%), 2000 SCF $H_2$/B, 0.25 V/V/Hour

| Catalyst (1/16" Extr.) | A | B | Feed[2] |
|---|---|---|---|
| Temperature. °F. | 600 | 670 | |
| Hydrotreated Product[1] | | | |
| Initial b. pt °F. | 726 | 800 | 800 |
| Yield, wt. % on feed | 85 | 93 | 100 |
| Visc. at 100°F., SUS | 328 | 350 | 427 |
| Specific gravity, 60 ° F.[3] | 0.869 | 0.870 | 0.881 |
| Sulfur, ppm | 6 | 2 | 300 |
| Refr. Ind. $n_{20}$ | 1.4758 | 1.4778 | 1.4838 |
| Aromatic C, % (by IR) | 1.6 | 2.6 | — |
| Silica gel separation | 97.4 | 91.9 | 79.7 |
| wt.% sats. | 2.0 | 6.3 | 16.7 |
| arom. | 99.4 | 98.2 | 96.4 |

[1]After topping to correct viscosity.
[2]TJ 102 distillate, solvent extracted and hydrofinished.
[3]Product specification-0.868 minimum.

The difference between the products resulting from use of the two catalysts lies principally in their aromatic content. Catalyst A gave a product which is significantly less aromatic than Catalyst B, i.e., 1.6% rather than 2.6% aromatic carbon atoms as measured by infrared, and 2.0 wt. % aromatics versus 6.3 wt. % aromatics as measured by silica gel chromatography. The product resulting from the use of Catalyst A meets the specifications for a technical white oil; whereas, the higher aromatic product resulting from the use of Catalyst B would not be acceptable as a technical white oil. Furthermore, the product resulting from the use of Catalyst A would be more readily converted into a medicinal white oil, by hydrogenation over a metallic catalyst or by acid treating, than the product obtained from the use of Catalyst B. In order to produce with Catalyst B, a product of the same low aromatic content as that of Catalyst A, it will be necessary to raise the hydrotreating pressure and/or to decrease the feed rate. It is thus apparent that the use of Catalyst A allows one to employ less severe, and therefore less costly, hydrotreating operations.

The process of this invention is also useful in the hydrogenation of jet fuels to reduce smoke points, luminometer numbers, etc., by means of aromatic separation. In addition, jet fuels from thermal conversion processes such as coking contain undesirable olefinic compounds which may also be reduced by hydrogenation. The catalyst here employed has higher hydrogenation activity than the conventional Group VI-B and/or Group VIII metals, such as nickel, platinum or palladium, supported on amorphous refractory metal oxides. Thus, jet fuel can be hydrogenated using lower pressures and/or higher space velocities. Furthermore, since the catalysts used in the process of this invention may have their metals in the form of sulfides, they are not readily deactivated by the traces of sulfur and nitrogen compounds present in jet fuel streams.

Use of the process of this invention in improving the properties of jet fuel is illustrated by the following example.

EXAMPLE 4

A distillate from Coastal Crude having a boiling range of 402° to 570° F. (5 and 95% off by G. C. Distillation ASTM D2887-70T) was hydrotreated using the two catalysts, Catalyst A according to the process of this invention and Catalyst B, a conventional cobalt molybdate on alumina. The composition of these catalysts has been previously described in Examples 1 and 3. Hydrotreating severity in each case was controlled by the reaction temperature and pressure, and the liquid throughput. As can be seen in Table VI below, Catalyst A of this invention reduced the feedstock aromatic content to a level well below the maximum jet fuel specification of 20 vol. % by FIA analysis at reduced temperature and pressure, and at double the throughput compared to Catalyst B.

TABLE VI

HYDROTREATING COASTAL DISTILLATE FOR JET FUEL

| Catalyst (1/16" Extr.) | Feed | A | B |
|---|---|---|---|
| Hydrotreating | | | |
| Temperature, °F. | — | 628 | 640 |
| Pressure, psig | — | 1500 | 1950 |
| Space Velocity, V/V/Hr. | — | 0.5 | 0.25 |
| Gas Rate, SCF/B | — | 2000 | 2000 |
| Hydrotreated-Topped Prod. | | | |
| Yield on Feed, wt. % | 100 | 92.5 | 92.5 |
| Aromatics by | | | |
| Silica Gel, wt. % | 23.8 | 8 | 6 |
| FIA,[1] vol. % | 27 | 10 | 8 |

[1] Fluorescent indicator absorption analysis ASTM D1319-66T

The hydrotreated products from both Catalysts A and B exhibit essentially the same smoke point, luminometer number, freezing point, pour point, color and flash, each being within the specification for jet fuel. For some jet fuel specifications, the final boiling point of the feedstock may have to be reduced slightly (e.g., to approximately 550° F.).

From the above data, it can be readily seen that considerable savings in catalyst inventory and equipment requirements result from using Catalyst A rather than Catalyst B for upgrading off-specification (e.g., high aromatic content) jet fuel.

EXAMPLE 5

This example illustrates the discovery that the hydrogenating temperature should not exceed about 720° F. at 5 wt. % crystalline aluminosilicate content of the catalyst in order to insure a minimum hydrocracking of feed to lower boiling products, with the maximum temperature decreasing as the crystalline aluminosilicate content increases.

The feed for this example was a heavy vacuum gas oil derived from a West Texas Sour Crude oil with a boiling range of from about 667° to 1103° F., as measured by gel chromatography, a nitrogen content of 1100 ppm and a sulfur content of 2.23 wt. %. This feed was passed, in the presence of hydrogen, over two different catalysts, A and B, comprising nickel tungstate on a mixture of Ni-faujasite and alumina. A contained 5 wt. % faujasite and B contained 30 wt. % faujasite. Both catalysts were substantially identical except for the faujasite content. The reaction conditions included a hydrogen pressure of 2500 psig and a space velocity of 0.5 V/V/hr. The extent of conversion of the feed to products boiling below about 700° F. as a function of hydrogenation temperature is plotted in the Figure. Thus, the Figure shows that at temperatures above about 700° F. for a 30% faujasite content, substantial amounts (greater than 20%) of feed were converted to lower boiling products, with the extent of conversion exponentially increasing to 100% conversion at a temperature of about 750° F. The maximum temperature for 5% faujasite was about 720° F.

What is claimed is:

1. A process for hydrogenating the olefin and aromatic compounds present in hydrocarbon feedstocks containing less than 100 ppm of nitrogen as nitrogen-containing organic compounds which comprises contacting the feedstock with hydrogen at hydrogenating conditions, including a temperature no higher than about 720° F., in the presence of a catalyst, the catalyst comprising a mixture of (1) an amorphous base component, (2) a crystalline aluminosilicate component comprising from 5–70 wt.% of the total catalyst and having a silica/alumina mole ratio of at least 2.5 and an alkali metal content of less than about 2.0 wt.% as alkali oxide, based on the total aluminosilicate component, and (3) a hydrogenation component, wherein said catalyst is pretreated with a hydrocarbon stream containing at least 100 ppm of nitrogen as nitrogen-containing organic compounds for a time sufficient to suppress cracking activity of said catalyst before same is used to hydrogenate the low nitrogen compound content feed stock.

2. The process of claim 1 wherein the catalyst treating conditions include a temperature within the range of from about 400° F. to 750° F., a pressure in the range of from about 500 to 10,000 psig and a liquid space velocity of from about 0.1 to about 10.0 V/V/hr.

3. The process of claim 2 wherein the crystalline aluminosilicate component of the catalyst comprises from about 5 to about 30 wt. % of the total catalyst.

4. The process according to claim 3 in which the amorphous base component of the catalyst comprises alumina.

5. The process according to claim 4 in which the amorphous base component is silica-stabilized alumina in which the molar ratio of the silica to the alumina is from 1:4 to 1:6.

6. The process according to claim 5 in which the hydrogenation component of the catalyst is selected from the group consisting of the oxides and sulfides of the nickel, tungsten, molybdenum and mixtures thereof.

7. The process of claim 2 wherein said treating hydrocarbon stream contains no more than 5 ppm of metals.

8. The process according to claim 7 in which the catalyst is pretreated with said nitrogen-containing hydrocarbon stream for a time sufficient to suppress cracking activity of said catalyst prior to said catalyst being contacted with said feedstock.

9. A process for producing white oils comprising contacting a raw or semi-refined petroleum distillate feedstock containing less than 100 ppm of nitrogen or nitrogen containing organic compounds, boiling above about 200° F., with hydrogen at hydrogenating conditions, including a temperature ranging between about 400° F. to 720° F., in the presence of a catalyst and recovering a white oil, the catalyst comprising a mixture of (1) an amorphous base component, (2) a crystalline aluminosilicate component comprising from 50–70 wt.% of the total catalyst and having a silica/alumina mole ratio of at least 2.5 and an alkali metal content of less than about 2.0 wt.% (as alkali oxide), based on a total aluminosilicate component, and (3) a hydrogenation component, and wherein said catalyst is pretreated with a petroleum distillate hydrocarbon stream containing at least 100 ppm of nitrogen as nitrogen-containing organic compounds for a time sufficient to suppress cracking activity of said catalyst before same is used to hydrogenate the low nitrogen compound content feedstock.

10. The process of claim 9 wherein at least 90% of the feed is converted to hydrogenated white oil product.

11. The process of claim 10 wherein the catalyst treating conditions are at a temperature in the range of from about 400° to 800° F., a pressure in the range of from about 500 to 10,000 psig and a liquid space velocity of from about 0.1 to about 10.0 V/V/hr.

12. The process of claim 11 wherein the crystalline aluminosilicate component of the catalyst comprises from about 5 to about 30 wt. % of the catalyst.

13. The process of claim 12 in which the amorphous base component of the catalyst comprises alumina and the hydrogenation component selected from the group consisting of the oxides and sulfides of nickel, tungsten, molybdenum and mixtures thereof.

14. The process of claim 11 wherein the catalyst is pretreated with said nitrogen-containing hydrocarbon stream for a time sufficient to suppress cracking activity of said catalyst prior to contacting said catalyst with said feedstock.

15. A process for saturating aromatic and olefinic components in petroleum distillate jet fuel feedstocks containing less than 100 ppm of nitrogen as nitrogen containing organic compounds boiling above about 200° F., which comprises contacting the petroleum distillate jet fuel feedstock with hydrogen at hydrogenating conditions, including a temperature ranging between about 400° F. to 720° F., in the presence of a catalyst and recovering a jet fuel product, the catalyst comprising a mixture of (1) an amorphous base component, (2) a crystalline aluminosilicate component comprising from 5 to 70 wt.% of the total catalyst having a silica/alumina mole ratio of at least 2.5 and an alkali metal content less than about 2.0 wt.% (as alkali oxide), based on the total aluminosilicate component, and (3) hydrogenation component, and wherein said catalyst is pretreated with a petroleum distillate hydrocarbon stream containing at least 100 ppm of nitrogen as nitrogen-containing organic compounds for a time sufficient to suppress cracking activity of said catalyst before same is used to hydrogenate the low nitrogen compound content feedstock.

16. The process of claim 15 wherein the catalyst treating conditions are at a temperature in the range of from about 400° to 800° F., a pressure in the range of from about 500 to 10,000 psig and a liquid space velocity of from about 0.1 to about 10.0 V/V/hr.

17. The process of claim 16 wherein the crystalline aluminosilicate component of the catalyst comprises from about 5 to about 30 wt. % of the total catalyst.

18. The process of claim 17 wherein the amorphous base component of the catalyst comprises alumina and hydrogenation component selected from the group consisting of the oxides and sulfides of nickel, tungsten, molybdenum and mixtures thereof.

19. The process of claim 18 wherein at least 80% of the feed is converted to hydrogenated jet fuel product.

20. The process of claim 16 wherein the catalyst is pretreated with said nitrogen-containing hydrocarbon stream for a time sufficient to suppress cracking activity of said catalyst prior to said catalyst being contacted with said feedstock.

* * * * *